US005608922A

United States Patent [19]

Lewis

[11] Patent Number: 5,608,922

[45] Date of Patent: Mar. 11, 1997

[54] TOILET STABILIZING AND SEALING GASKET

[76] Inventor: William I. Lewis, 4724 Eastern Ave., NE., Washington, D.C. 20017

[21] Appl. No.: 550,626

[22] Filed: Oct. 31, 1995

Related U.S. Application Data

[63] Continuation-in-part of Ser. No. 407,084, Mar. 20, 1995, abandoned.

[51] Int. Cl.[6] ..... A47K 17/00

[52] U.S. Cl. ..... 4/251.1; 4/252.5; 137/312

[58] Field of Search ..... 4/251.1, 251.2, 4/252.1, 252.4, 252.5, 252.6, 695, DIG. 18, 637, 657, 658; 137/312

[56] References Cited

U.S. PATENT DOCUMENTS

| | | | |
|---|---|---|---|
| 670,418 | 3/1901 | Duffy | 4/637 |
| 696,183 | 3/1902 | McAuliffe . | |
| 760,863 | 4/1903 | Hinsdale . | |
| 918,396 | 10/1907 | Tracy . | |
| 1,533,444 | 4/1925 | Mohr . | |
| 2,229,814 | 12/1938 | Mikolajczak et al. . | |
| 2,650,855 | 9/1953 | Peirce | 4/657 |
| 3,360,805 | 12/1965 | Aumann . | |
| 3,821,820 | 7/1974 | Thompson . | |
| 3,846,851 | 11/1974 | Pepper . | |
| 4,165,545 | 8/1979 | Stoltzfus . | |
| 4,285,075 | 8/1981 | Nelson . | |
| 4,423,526 | 1/1984 | Izzi, Sr. . | |
| 4,482,161 | 11/1984 | Izzi, Sr. . | |
| 4,757,560 | 7/1988 | Grimstad . | |
| 4,940,113 | 7/1990 | L'Heureux . | |
| 4,984,308 | 1/1991 | Handal . | |
| 5,185,890 | 2/1993 | Dismore et al. | 4/252.1 |
| 5,335,849 | 8/1994 | Forbes . | |

*Primary Examiner*—Henry J. Recla
*Assistant Examiner*—Charles R. Eloshway
*Attorney, Agent, or Firm*—Richard C. Litman

[57] ABSTRACT

A rubber gasket slightly larger than the footprint of a standard toilet base. The gasket has central hole for surrounding the soil pipe or connection flange from the toilet. A lip surrounds the gasket and the hole to retain any liquid leaked onto the gasket. Optional extensions to the gasket may be placed under other components of the toilet from which leaks are likely, such as the water supply valves. The gasket pads the toilet from the floor surface and protects the floor from any slow leaks from the toilet. The gasket is particularly useful for protection from deteriorated wax seals between the toilet and the drain flange. Any slow leaks through a wax seal will be captured on the gasket and will thus be evident to observers as wetness on the gasket. Without the flange the slow leak would seep into the floor and the ceiling below, most likely causing major damage before it was detected.

1 Claim, 2 Drawing Sheets

TOILET STABILIZING AND SEALING GASKET

CROSS-REFERENCE TO RELATED APPLICATION

This application is a continuation-in-part of application Ser. No. 08\407,084, filed Mar. 20, 1995, now abandoned.

BACKGROUND OF THE INVENTION

1. Field of the Invention

The present invention relates to gaskets for protecting floors under and around toilets. Specifically the invention relates to a secondary gasket for retaining seepage through a primary seal between the toilet and a closet flange. This secondary gasket also acts a pad protecting the floor from the base of the toilet.

2. Description of the Prior Art

The successful seal of a toilet to an associated soil pipe has been a long standing problem to which many solutions have been proposed. Most inventions addressing this problem have dealt with improving the primary seal between the toilet and the soil pipe. Proposed seals have been designed to be more effective, longer lasting, or more convenient to install. Few secondary systems have been developed to protect the floor under the toilet in the event the primary seal fails or which provide warning of the failure of the primary seal.

Many devices have been developed which attempt to form a successful seal between a toilet and soil pipe. For example, U.S. Pat. No. 696,183, issued Mar. 25, 1902, to J. W. McAuliffe discloses a rubber gasket for the joint between a toilet and soil pipe. Toilets are commonly connected to a drain pipe or soil pipe through the use of a closet flange. U.S. Pat. No. 3,846,851, issued Nov. 12, 1974, to K. V. Pepper shows such a flange. The closet flange is typically secured to the floor. The toilet in turn is secured to the closet flange. The soil pipe must be sealed to the flange. U.S. Pat. No. 4,984,308, issued Jan. 15, 1991, to V. H. Handal shows a method of sealing the closet flange to the soil pipe. The sealing of the flange to the soil pipe has not been a chronic problem since the flange and soil pipe are frequently made from similar materials. However, the seal between the dissimilar materials of the toilet bowl and the closet flange has proven to be a difficult problem to overcome. Commonly a wax ring seal is used between the flange and the toilet base to form a seal as is shown in U.S. Pat. No. 3,821,820, issued Jul. 2, 1974, to M. G. Thompson. As Thompson relates, the traditional wax ring seal may not be totally satisfactory against leakage after a period of time. A number of alternatives to the wax ring seal have been proposed. U.S. Pat. No. 4,423,526, issued Jan. 3, 1984, and U.S. Pat. No. 4,482,161 issued Nov. 13, 1984, to L. B. Izzi, Sr. show examples of such alternatives.

A number of configurations of flanges and gaskets have been proposed to facilitate the installation of toilet bowls. U.S. Pat. No. 760,863 issued May 24, 1904, to W. E. Hinsdale shows a flange which is screwed to the soil pipe and has a plurality of vertical rings meant to be cemented to similar grooves in the base of the toilet. U.S. Pat. No. 3,360,805 issued Jan. 2, 1968, to W. E. Aumann shows a rubber flange between the toilet and the soil pipe which provides for the adjustment of the position of the toilet with respect to the soil pipe. U.S. Pat. No. 5,335,849 issued Aug. 9, 1994, to C. B. Forbes shows a flange for rejoining the toilet to the soil pipe following repair of the floor under the toilet. U.S. Pat. No. 1,533,444 issued Apr. 14, 1925, to O. H. Mohr shows a floor slab for mounting a bathroom fixture such as a toilet. None of these installation devices provide a secondary seal protecting the floor from primary seal leakage.

Devices which extend under the edge of a toilet base include U.S. Pat. No. 4,940,113 issued Jul. 10, 1990, to G. L'Heureux which discloses a method of acoustically insulating a toilet bowl by inserting a strip of foam rubber under the edge of the toilet base. U.S. Pat. No. 4,285,075 issued Aug. 25, 1981 to A. J. Nelson shows a mat for absorbing liquid spilled near a toilet. The mat surrounds a toilet base but does not extend under the edge of the base.

Also of interest are pads which are designed to protect the floor from condensation dripping from the toilet, toilet overflow, or from leaks originating from seals within the toilet itself such as the seal between the toilet bowl and the tank disclosed in U.S. Pat. No. 4,757,560 issued Jul. 19, 1988, to R. N. Grimstad. Such pads are shown in U.S. Pat. No. 918,396 issued Apr. 13, 1909, to B. F. Tracy, U.S. Pat. No. 2,229,814 issued Jan. 18, 1941, to T. Mikolajczak et al. and U.S. Pat. No. 4,165,545 issued Aug. 28, 1979, to S. D. Stoltzfus. The Tracy and Mikolajczak pads extend under the toilet; however, neither pad cooperates with closet flange to catch leaks emanating from the primary seal. Unlike the present invention, neither pad makes a provision for preventing liquid on the pad from escaping onto the floor at the opening for the soil pipe. In fact these pads appear to rely on a substantially waterproof seal between the bottom edge of the toilet and the pad to keep leaked or spilled liquid on the outside of the toilet from seeping under the toilet. The Mikolajczak pad itself includes the primary seal between the soil pipe and toilet and thus provides no secondary sealing means. As a primary seal for joining a toilet and closet flange which is absolutely effective over a period of time has not been demonstrated, there is a need to protect the floor from leaks flowing through the primary seal.

None of the above inventions and patents, taken either singly or in combination, is seen to describe the instant invention as claimed.

SUMMARY OF THE INVENTION

The gasket according to the present invention supplements the primary seal between a toilet and an associated soil pipe. The primary seal must provide a gas and water tight seal between the dissimilar materials of the closet flange and the toilet base. This primary seal is most commonly a deformable ring composed of a wax like substance which is compressed between the flange and the toilet base. Primary seals between a toilet and a soil pipe are known to be susceptible to leaks over time, especially when subjected to changes in temperature or stress at the joint. These leaks are frequently very slow leaks which are easily absorbed by the floor. Thus, the first sign of the leak may then be the collapse of a rotten floor or a waterlogged ceiling below the toilet. The present invention provides a gasket which protects the floor from leaks through the primary seal between the closet flange to the toilet base. The gasket contains any leaked liquid in an area which extends beyond the outside of the footprint of the toilet. The gasket, thus, provides for detection of the leak in a timely fashion, allowing the primary seal to be replaced prior to damage occurring to the building structure under the toilet.

The gasket of the present invention consists of a resilient and flexible pad configured with an opening to fit snugly around a soil pipe or closet flange. The gasket extends from the soil pipe to beyond the outer edges of the toilet base. The gasket, thus, collects liquids leaked from any portion of the toilet. The gasket includes a raised lip around an outer edge and also a raised lip around the interior opening for the soil pipe. This lip contains any liquid on the gasket. The gasket may also include a depression at a point of contact between the gasket and the base of the toilet to provide a channel under the base of the toilet. The channel prevents liquid leaked under the toilet base from becoming trapped under the toilet. The gasket may include extension members to extend under other parts of the toilet assembly susceptible to leaks such as the water inlet valves. The gasket may also conform to the color and shape of the toilet so as to be aesthetically pleasing. A further inherent advantage to the invention is separation of the toilet from the floor thus protecting each from damages from the other.

Accordingly, it is a principal object of the invention to provide a gasket for protecting the floor under a toilet from leaks, especially leaks through the primary seal between the toilet base and the closet flange.

It is another object of the invention to contain any leaks to an area which extends beyond the footprint of the toilet so that the leak is exposed to detection.

It is a further object of the invention to protect the toilet base and the floor from damaging one another.

Still another object of the invention is to provide extensions to the gasket to catch leaks emanating from any part of the toilet.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
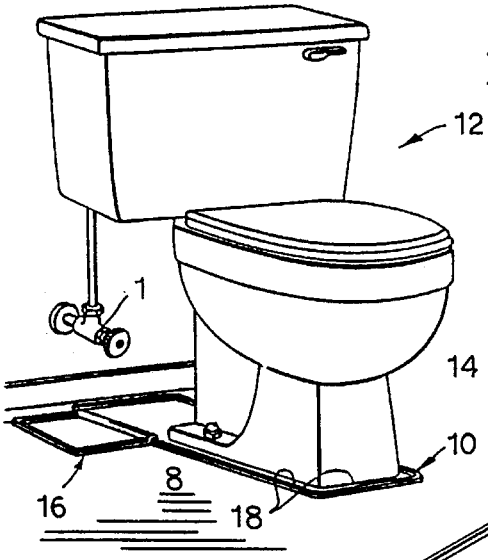
FIG. 1 is an environmental perspective view of a gasket according to the present invention shown in place under a toilet.

The toilet stabilizing and sealing gasket 10 according to the present invention is shown between a typical toilet 12 and floor 8 in FIG. 1. Sealing gasket 10 is configured to cover an area of floor 8 extending beyond the area covered by the base 14 of toilet 12. Gasket 10 is thus provides a waterproof barrier to retain leaks falling from any part of toilet 12. Gasket 10 also allows leaks captured under toilet 12 to appear outside the footprint of base 14 while remaining retained on gasket 10. Gasket 10 may include extensions 16 which capture leaks from such sources as water supply valves 19.

Figure 2:
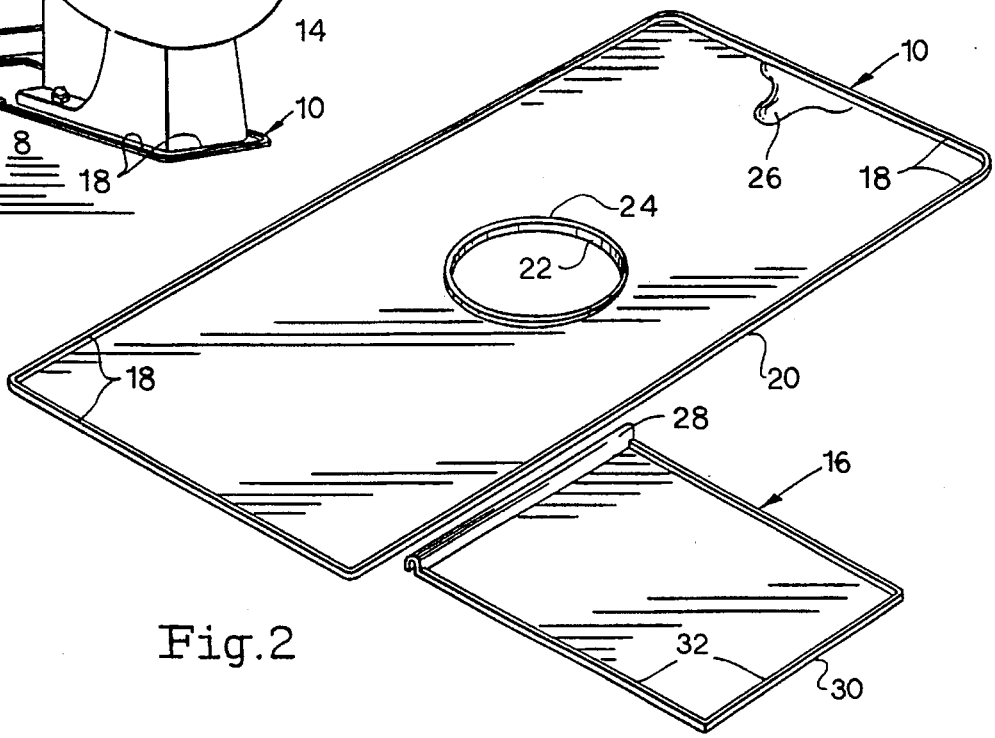
FIG. 2 is perspective view of the gasket of FIG. 1.

Toilet stabilizing and sealing gasket 10 is shown in detail in FIG. 2. Gasket 10 is a planar pad made of a soft flexible waterproof material such as rubber. Gasket 10 has an outer edge 20 from which extends a raised lip 18. Lip 18 serves to prevent any liquid leaked upon gasket 10 from running off edge 20. Gasket 10 further includes an inner edge 22 defining a circular opening dimensioned to tightly fit around a closet flange. A raised lip 24 is also provided around inner edge 22 to retain any leaked liquid on gasket 10. A depression 26 may be disposed on gasket 10 in a position to be placed under the edge of base 14. Depression 26 provides a channel under the edge of base 14, thus preventing liquid from becoming trapped under toilet 12. Leaks accumulating under toilet 12 may thus flow to the outside of base 14 and are detected before contacting floor 8. Extension 16 is shown separated from outer edge 20. Extension 16 has an outer edge 30. Channel 28 is formed along a portion of edge 30. Channel 28 has a downward facing groove for engaging lip 18. A raised lip 32 is formed along the remainder of edge 30.

Figure 3:
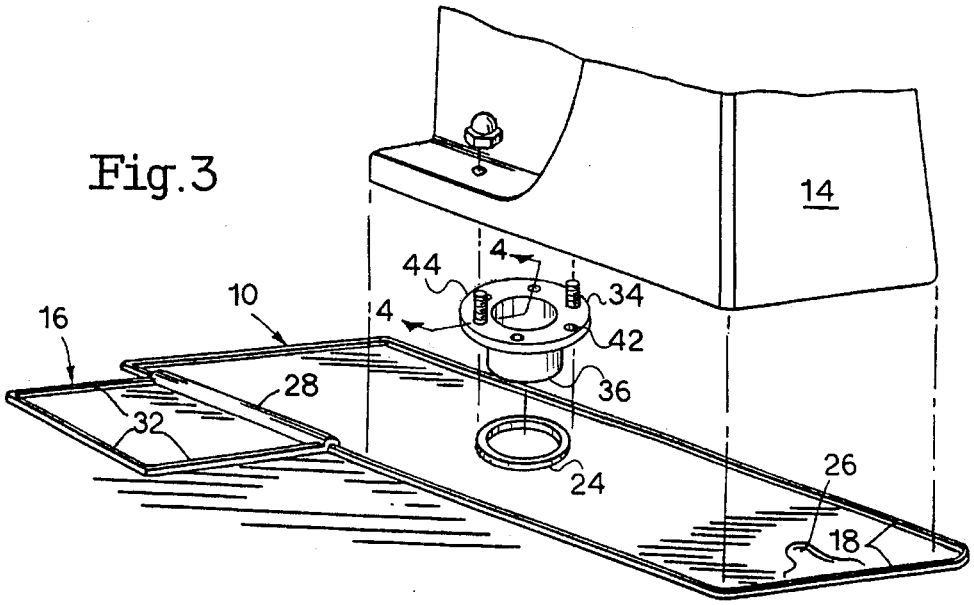
FIG. 3 is an exploded environmental perspective view of the gasket of FIG. 1 showing the flange for connecting the toilet to a soil pipe.
Figure 4:
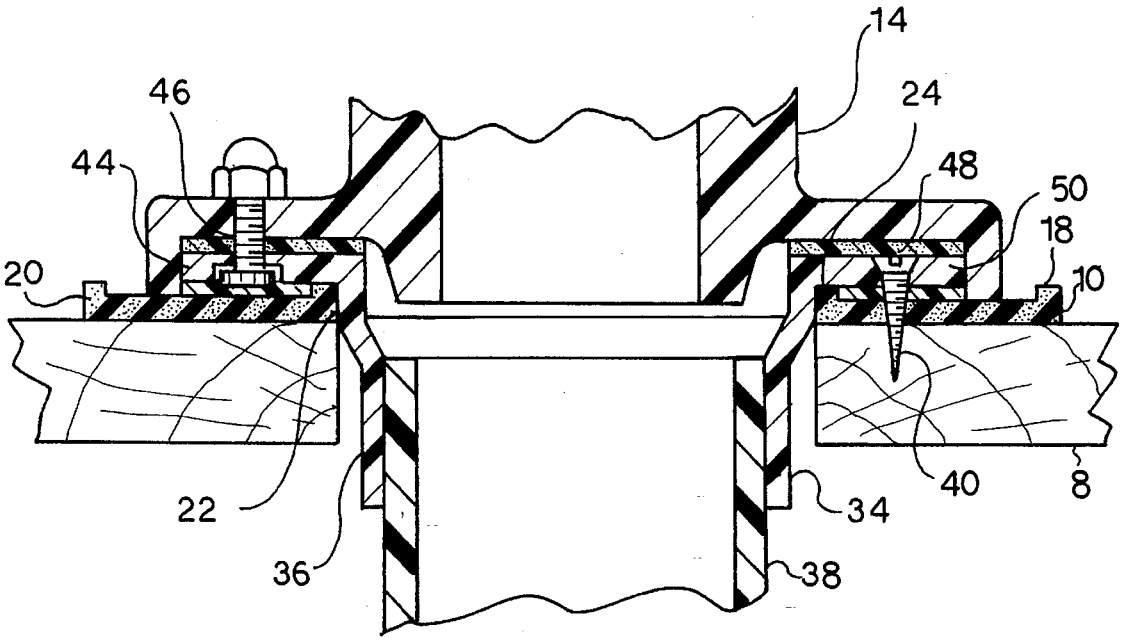
FIG. 4 is a section view taken along line 4—4 of FIG. 3.

FIG. 3 shows extension 16 connected to outer edge 20 by channel 28. FIG. 3 further shows an exploded view of a toilet installation including gasket 10, base 14, and closet flange 34. The relationship between gasket 10, base 14, and closet flange 34 is shown in FIG. 4 in a section taken along line 4—4 of FIG. 3. Gasket 10 lies on floor 8 with inner edge 22 sealingly contacting closet flange 34. Closet flange 34 includes a substantially cylindrical portion 36 which passes through the interior opening in gasket 10. Cylindrical portion 36 is sealed to soil pipe 38. Generally perpendicular to cylindrical portion 36 extends circular portion 44. Circular portion 44 is secured to floor S by screws 40 passing through screw holes 42. Screws pass through gasket 10 and are sealed with a sealant 50 such as a silicone sealant. Toilet base 14 is bolted to closet flange 34 with bolts 46. A wax ring 48 is typically employed as the primary sealing unit between base 14 and closet flange 34.

As shown in FIG. 4 inner edge 22 of gasket 10 is maintained in a tight fitting sealed position around cylindrical portion 36 of closet flange 34. Gasket 10, thus, extends from outside base 14 under circular portion 44 of closet flange 34. With this arrangement any liquid leaked through wax ring 48 will be retained on gasket 10 and will be visible between lip 18 and base 14 without contacting floor S. Leaked liquid present between lip 18 and base 14 indicates that wax ring 48 should be inspected.

Installation of gasket 10 is accomplished by the following method. Gasket 10 is placed on floor 8 in the orientation in which it is desired to install toilet 12. The interior opening defined by inner edge 22 is positioned over soil pipe 38. Gasket 10 is sealed to closet flange 34 as closet flange 34 is attached to soil pipe 38 and floor S. The wax ring 48 is installed on closet flange 34 and toilet 12 is bolted to flange 34. In this manner all leaks seeping through wax ring seal 48 are captured on gasket 10.

Figure 5:
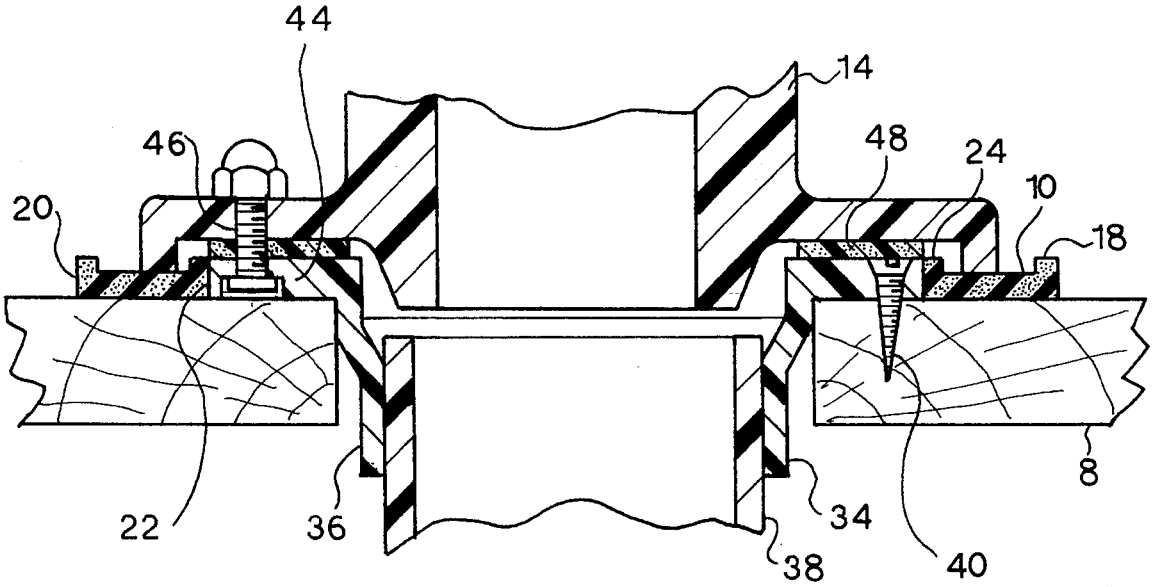
FIG. 5 is a section view similar to FIG. 4, but showing an alternative embodiment of the gasket according to the present invention.

An alternate arrangement is shown in FIG. 5. The installation of gasket 10 in FIG. 5 does not require the removal of a closet flange if previously installed. In this arrangement inner edge of gasket 22 is maintained in a tight fitting position around the perimeter of circular portion 44 of closet flange 34. Gasket 10 is sealed to outer edge of closet flange 34. This arrangement is easily installed on existing closet flanges at a small increased risk of leaks occurring between gasket 10 and closet flange 34.

It is to be understood that the present invention is not limited to the embodiments described above, but encompasses any and all embodiments within the scope of the following claims.

I claim:

1. A toilet stabilizing and sealing gasket for protection of a floor under a toilet by providing for retention and detection of leakage through a primary seal between a base of a toilet and a soil pipe, the gasket comprising:

a primary rubber planar pad having an outer edge, dimensioned and configured to extend beyond the base of the toilet, and an inner edge defining an interior circular opening in said pad, the opening dimensioned and configured to tightly fit around a closet flange connecting the toilet to the soil pipe, said primary pad including:

a raised lip surrounding said outer edge of said pad;

a raised lip surrounding said inner edge of said pad;

a depression for preventing the retention of water under the base of the toilet; and a secondary rubber planar pad having an outer edge, said secondary pad including:

a connection channel formed on a portion of the outer edge of said secondary pad, said connection channel defining a groove for cooperation with said raised lip surrounding said outer edge of said primary pad; and a raised lip surrounding said outer edge of said secondary pad.

* * * * *